US011465881B2

(12) United States Patent
Shi

(10) Patent No.: US 11,465,881 B2
(45) Date of Patent: Oct. 11, 2022

(54) GOVERNOR ASSEMBLY AND ELEVATOR SYSTEM

(71) Applicant: Otis Elevator Company, Farmington, CT (US)

(72) Inventor: Zhengbao Shi, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 698 days.

(21) Appl. No.: 16/391,974

(22) Filed: Apr. 23, 2019

(65) Prior Publication Data

US 2019/0330019 A1 Oct. 31, 2019

(30) Foreign Application Priority Data

Apr. 25, 2018 (CN) ..... 201810378395.7

(51) Int. Cl.

| | |
|---|---|
| ***B66B 5/04*** | (2006.01) |
| ***B66B 1/32*** | (2006.01) |
| ***B66B 1/34*** | (2006.01) |
| ***B66B 5/06*** | (2006.01) |
| ***B66B 7/06*** | (2006.01) |
| ***B66D 1/56*** | (2006.01) |

(52) U.S. Cl.

CPC ..... *B66B 5/044* (2013.01); *B66B 1/32* (2013.01); *B66B 1/343* (2013.01); *B66B 5/06* (2013.01); *B66B 7/06* (2013.01); *B66D 1/56* (2013.01)

(58) Field of Classification Search

CPC ..... B66B 5/044; B66B 5/046; B66D 1/54

See application file for complete search history.

(56) References Cited

U.S. PATENT DOCUMENTS

| | | | |
|---|---|---|---|
| 5,377,786 | A | 1/1995 | Nakagawa |
| 6,227,334 | B1 | 5/2001 | Yumura et al. |
| 6,345,696 | B1 | 2/2002 | Yumura |
| 7,607,516 | B2 | 10/2009 | Simon et al. |
| 8,939,262 | B2 | 1/2015 | Schienda et al. |
| 2013/0098711 | A1 | 4/2013 | Aguado et al. |

FOREIGN PATENT DOCUMENTS

| | | | | |
|---|---|---|---|---|
| CN | 1597485 | A * | 3/2005 | ..... B66B 5/044 |
| CN | 101284617 | A | 10/2008 | |
| CN | 101445199 | A | 6/2009 | |

(Continued)

OTHER PUBLICATIONS

Machine Translation of CN 1597485.*

European Search Report for application EP 19169970.1, dated Oct. 7, 2019, 21 pages.

*Primary Examiner* — Diem M Tran

(74) *Attorney, Agent, or Firm* — Cantor Colburn LLP

(57) ABSTRACT

A speed governor assembly and an elevator system. The speed governor assembly includes: a sheave; a centrifugal mechanism mounted on the sheave and rotating together with the sheave; an overspeed protection switch at a first distance from a radial outer side of the centrifugal mechanism; a core ring disposed coaxially with the sheave; and a triggering arm rotating together with the core ring; wherein the centrifugal mechanism engages with the core ring and drives the core ring and the triggering arm to rotate when the sheave reaches a second speed, and the rotation of the triggering arm can contact and trigger the overspeed protection switch.

17 Claims, 6 Drawing Sheets

(56) References Cited

FOREIGN PATENT DOCUMENTS

| | | | | | |
|---|---|---|---|---|---|
| CN | 203461654 | U | | 3/2014 | |
| CN | 204549702 | U | | 8/2015 | |
| CN | 205151436 | U | | 4/2016 | |
| CN | 205472083 | U | | 8/2016 | |
| CN | 209143437 | U | * | 7/2019 | |
| EP | 1497214 | A1 | | 1/2005 | |
| EP | 2928804 | A1 | | 10/2015 | |
| KR | 20130053078 | A | | 5/2013 | |
| WO | WO-2006090453 | A1 | * | 8/2006 | ..... B66B 5/044 |
| WO | 2008125133 | A1 | | 10/2008 | |

* cited by examiner

GOVERNOR ASSEMBLY AND ELEVATOR SYSTEM

FOREIGN PRIORITY

This application claims priority to Chinese Patent Application No. 201810378395.7, filed Apr. 25, 2018, and all the benefits accruing therefrom under 35 U.S.C. § 119, the contents of which in its entirety are herein incorporated by reference.

TECHNICAL FIELD

The present invention relates to the field of elevator safety and, more particularly, to a speed governor assembly for an elevator and an elevator having such a speed governor assembly.

BACKGROUND ART

With the development of speed governor assembly technology for elevators, a new Car Mounted Governor (CMG) assembly has been more widely used. The car mounted speed governor assembly is more compact than conventional speed governor assemblies with or without a machine room. A speed governor assembly is disclosed in U.S. Pat. No. US 2013/0098711A1, issued to Aguado et al, published on Apr. 25, 2013, in which the speed governor assembly includes a centrifugal mechanism gradually deployed as a rotational speed of a sheave increases. When the sheave reaches a first speed, the outer side of the centrifugal mechanism pushes an overspeed protection switch, thereby braking the elevator through an electrical mechanism. If the speed of the sheave continues to increase to a second speed, the centrifugal mechanism will drive a core ring in the inner side thereof, thereby triggering a mechanical brake device. The first speed and the second speed are related to the basic running speed of the elevator, and the ratio of the first speed to the second speed is required to meet national standards, for example, less than a specific value, such as 90%.

In the application of low-speed elevators, since the basic running speed of the elevator is small, the difference between the first speed and the basic running speed is also small, and the problem is that the speed governor is triggered falsely. If the overspeed protection switch is set farther, the first speed can be increased to widen the difference between the first speed and the basic running speed, thereby reducing the possibility of false triggering. However, this may result in that the overspeed protection switch is not triggered or triggered later than the mechanical brake device, which may cause damage to related components in the elevator system and does not meet relevant national safety standards.

SUMMARY OF THE INVENTION

The objective of the present invention is to solve or at least alleviate the problems existing in the prior art; according to some features, it is an objective of the present invention to ensure that the electrical brake device of the speed governor assembly is triggered not later than the mechanical brake device.

According to some features, it is an objective of the present invention to allow the overspeed protection switch to be set farther to reduce the possibility of false triggering of the speed governor.

According to some features, it is an objective of the present invention to provide a simple and reliable mechanism or to make a modification as small as possible to an existing mechanism to achieve the above objectives.

In one aspect, a speed governor assembly is provided, including: a sheave; a centrifugal mechanism mounted on the sheave and rotating together with the sheave; an overspeed protection switch at a first distance from a radial outer side of the centrifugal mechanism; a core ring disposed coaxially with the sheave; and a triggering arm rotating together with the core ring; wherein the centrifugal mechanism engages with the core ring and drives the core ring and the triggering arm to rotate when the sheave reaches a second speed, and the rotation of the triggering arm can contact and trigger the overspeed protection switch.

Optionally, in the speed governor assembly, when the sheave reaches a first speed, the centrifuge mechanism is deployed to a degree such that it can contact and trigger the overspeed protection switch.

Optionally, in the speed governor assembly, the first distance is set such that a ratio of the first speed to the second speed is in a range of 0.9-1.0 (excluding 1.0) preferably, in a range of 0.95-1.0 (excluding 1.0).

Optionally, in the speed governor assembly, the triggering arm is directly connected to the core ring.

Optionally, in the speed governor assembly, the core ring is connected to a rocker arm, and the triggering arm is connected to the rocker arm.

Optionally, in the speed governor assembly, the core ring drives the rocker arm to rotate and triggers a mechanical brake device when the sheave reaches the second speed.

Optionally, in the speed governor assembly, the rocker arm has a first end and a second end, the first end of the rocker arm is connected to the core ring, and the second end of the rocker arm is connected to a safety gear pull rod.

Optionally, in the speed governor assembly, the triggering arm is connected between the first end and the second end of the rocker arm and extends upwardly.

Optionally, in the speed governor assembly, the triggering arm is in a shape of plate or column, and the triggering arm has a proximal end for connection with the rocker arm or the core ring and a distal end for triggering the overspeed protection switch.

Optionally, in the speed governor assembly, the distal end of the triggering arm has an axial extension portion that is aligned with a contact end of the overspeed protection switch.

Optionally, in the speed governor assembly, the proximal end of the triggering arm is connected to the rocker arm or the core ring through a plurality of bolts.

Optionally, in the speed governor assembly, the triggering arm and the overspeed protection switch are on the same side of the rotation axis of the sheave.

Optionally, in the speed governor assembly, the overspeed protection switch is above the triggering arm.

Optionally, in the speed governor assembly, the centrifugation mechanism includes a plurality of centrifugal block supports each carrying a centrifugal block, a plurality of connecting rods connected between the plurality of centrifugal block supports and a retaining mechanism holding the plurality of centrifugal block supports together.

Optionally, in the speed governor assembly, when the sheave reaches a first speed, the centrifugal block support is deployed to a degree such that the overspeed protection switch can be triggered.

Optionally, in the speed governor assembly, when the sheave reaches the second speed, a roller inside the plurality of connecting rods of the centrifugal mechanism engages with the core ring and drives the core ring to rotate.

Optionally, in the speed governor assembly, the retaining mechanism is a spring device or a magnetic device.

Optionally, in another aspect, an elevator system is provided. The elevator system is configured with the speed governor assembly described in various embodiments.

Optionally, in the elevator system, the speed governor assembly is mounted to an elevator car.

Optionally, in the elevator system, a basic running speed of the car in the elevator system is less than 1.0 m/s.

The speed governor assembly and the elevator system according to the present invention ensure that the electrical brake device of the elevator system is triggered not later than the mechanical brake device and eliminate the possibility that electrical action speed of the speed governor does not meet the requirements of the relevant national standards.

BRIEF DESCRIPTION OF THE DRAWINGS

The disclosure of the present invention will become more apparent from the drawings. Those skilled in the art will readily appreciate that the drawings are for illustrative purposes only and are not intended to limit the protection scope of the present invention. In addition, similar numbers in the figures are used to indicate similar components, in which.

DETAILED DESCRIPTION

It is to be understood that, according to the technical solution of the present invention, one of ordinary skill in the art can propose various configurations and implementations that can be interchanged without departing from the spirit of the present invention. Therefore, the following detailed description and the accompanying drawings are merely illustrative of the technical solution of the present invention, and should not be considered as the whole of the present invention or restriction or limitation on the technical solution of the present invention.

The orientation terms of top, bottom, left, right, front, back, front, rear, top, bottom, etc. mentioned or may be mentioned in this specification are defined with respect to the configurations shown in the respective drawings. They are relative concepts, so they may change accordingly depending on their location and usage. Therefore, these or other orientation terms should not be interpreted as restrictive terms.

Figure 1:
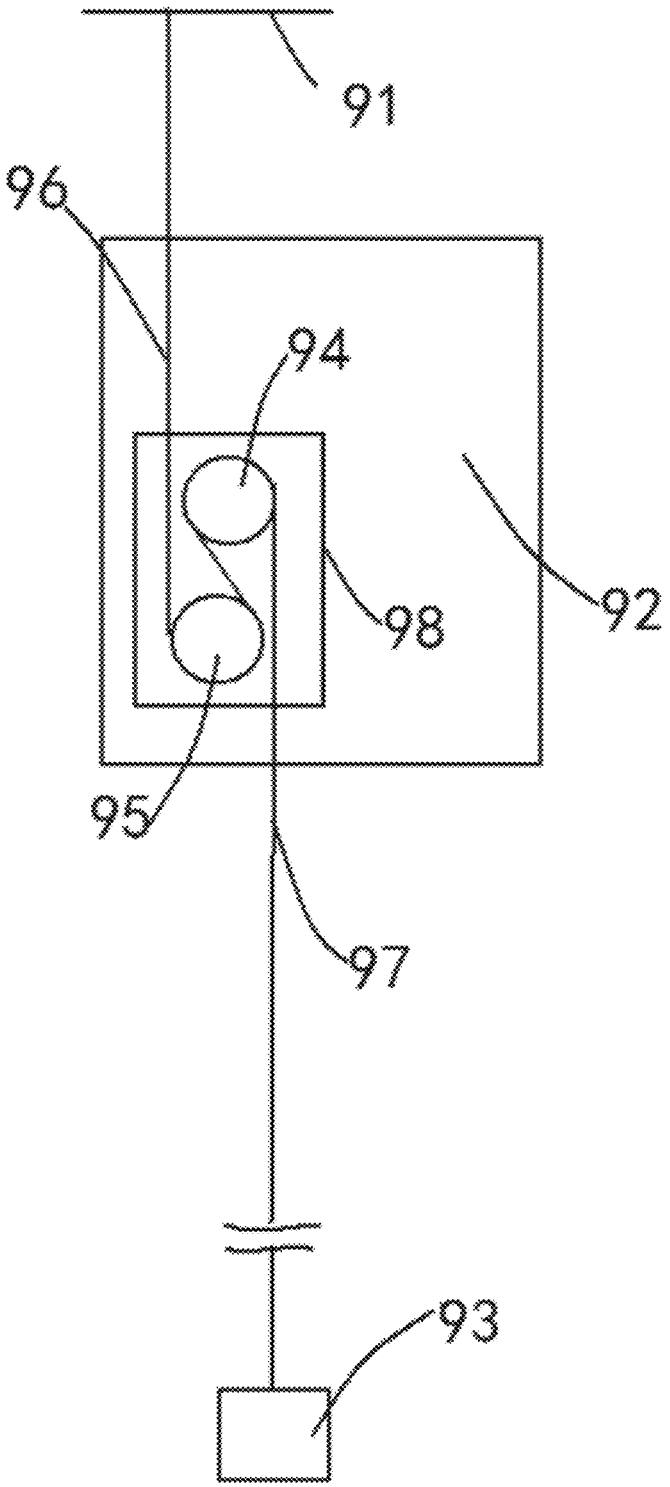
FIG. 1 illustrates a schematic view of an elevator system having a car mounted speed governor.

Referring first to FIG. 1, an elevator system having a car mounted speed governor assembly is illustrated. It should be understood that although various embodiments of the present invention are described with respect to a car mounted speed governor assembly, the core ring assembly of the present invention can be used with various types of speed governors, not limited to those shown in the various views or embodiments. A car 92 is shown in FIG. 1 with a speed governor assembly 98 mounted thereon. A typical speed governor assembly 98 can be found, for example, in the type described in U.S. Patent Publication No. US20130098711 A1 to Otis Elevator Company, published on Apr. 25, 2013, which is hereby incorporated by reference in its entirety. The speed governor assembly 98 includes a guide pulley 95 and a speed governor sheave 94. A rope suspended from a hoistway top 91 winds around the guide pulley 95 and the speed governor sheave 94. The rope has a speed governor upstream rope portion 96 and a speed governor downstream rope portion 97, and the length of the speed governor upstream rope portion 96 and the length of the speed governor downstream rope portion 97 constantly change during ascending or descending processes of the car. At the bottom of the hoistway, the bottom end of the speed governor downstream rope portion 97 is suspended with a weight 93 or connected to a pulling device that provides tension for the rope. During the ascending or descending processes of the car 92, the guide pulley 95 and the speed governor sheave 94 will rotate due to friction with the rope. The rotation linear speed of the pitch circle of the speed governor sheave 94 is the same as the running speed of the car. When the descending speed of the elevator car exceeds a critical value, the centrifugal mechanism associated with the speed governor sheave 94 triggers the electric brake device since the sheave speed exceeds the first speed, cuts off the power supply of the elevator drive motor, and stops the drive sprocket. When the sheave speed exceeds a second speed higher than the first speed, the centrifugal mechanism triggers the mechanical brake device to brake the elevator car by friction with the guide rail.

Figure 2:
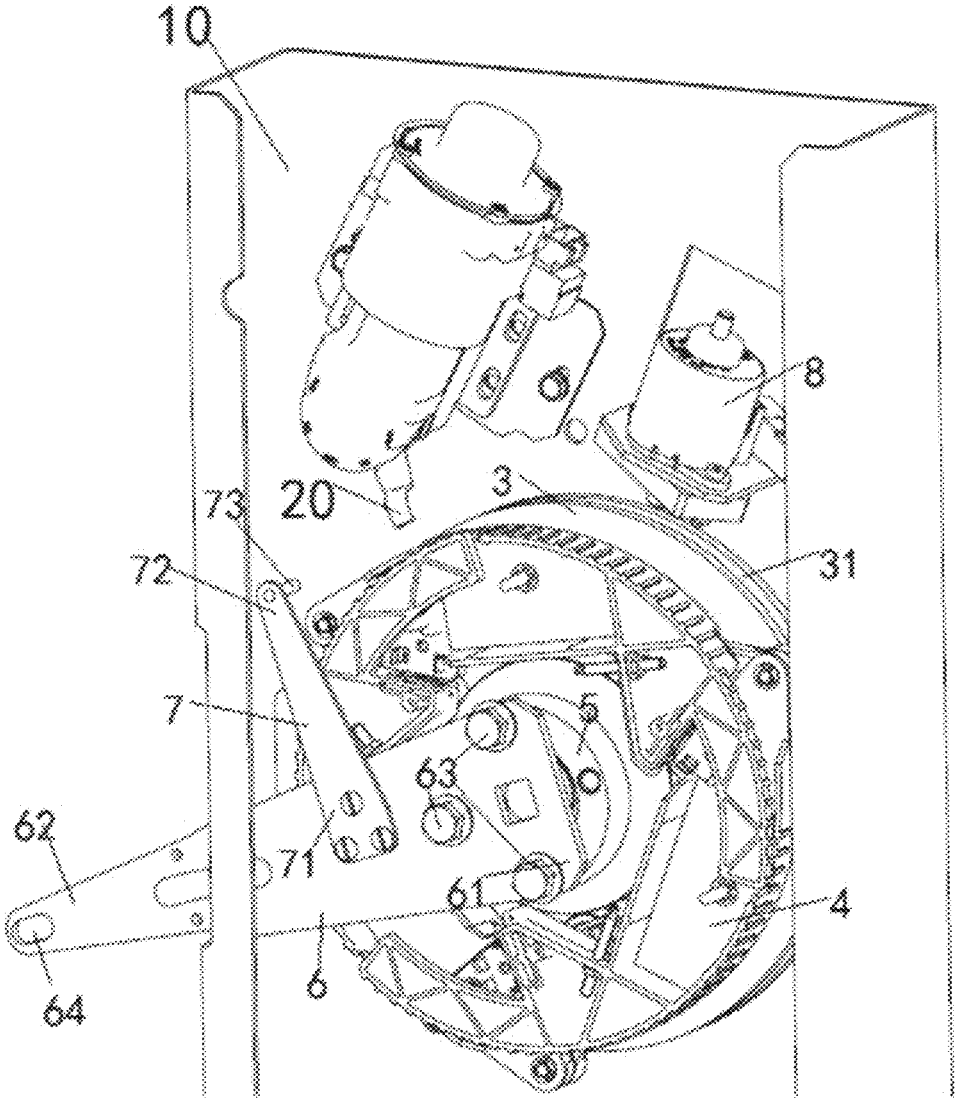
FIGS. 2 and 3 illustrate perspective views, viewed at different angles, of a speed governor assembly according to an embodiment.
Figure 3:
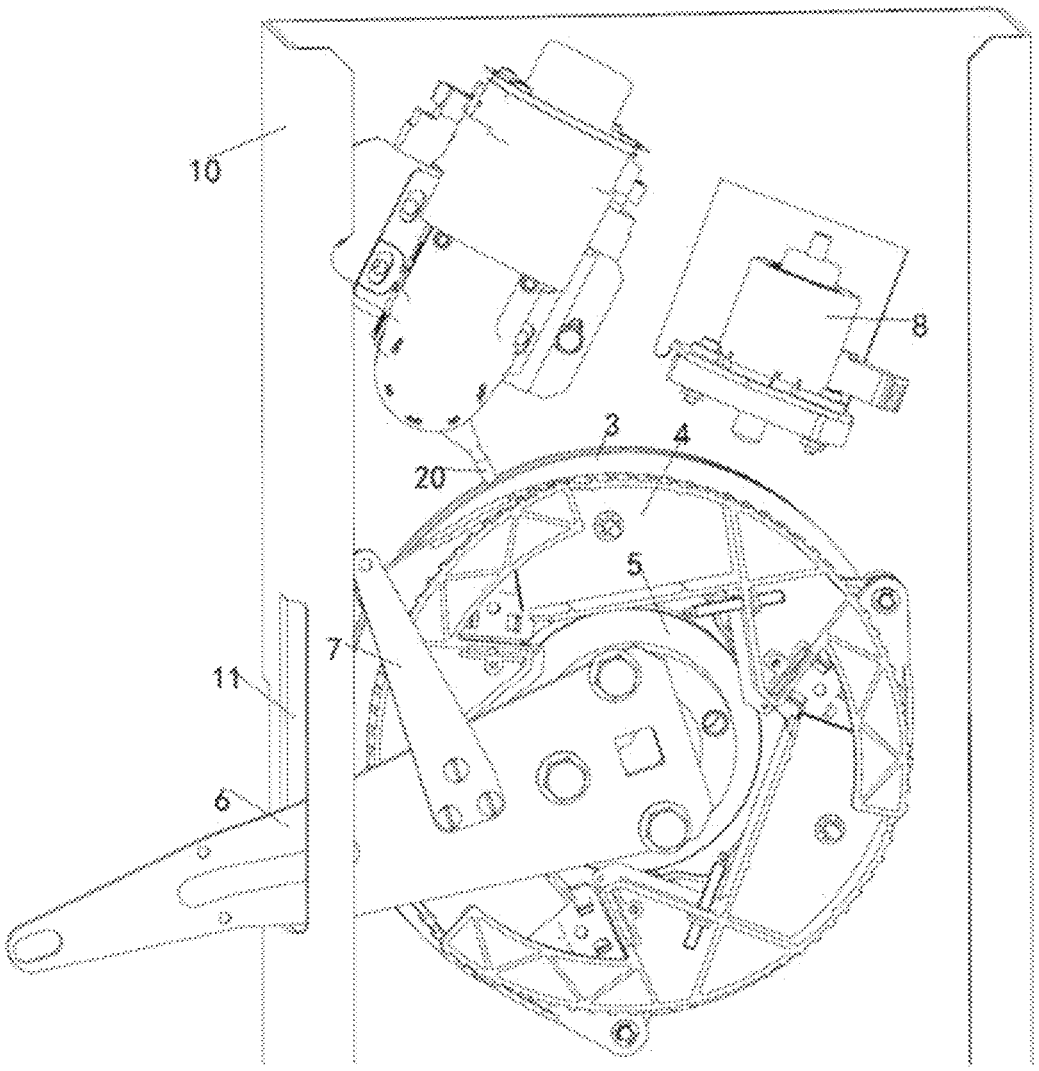
Figure 4:
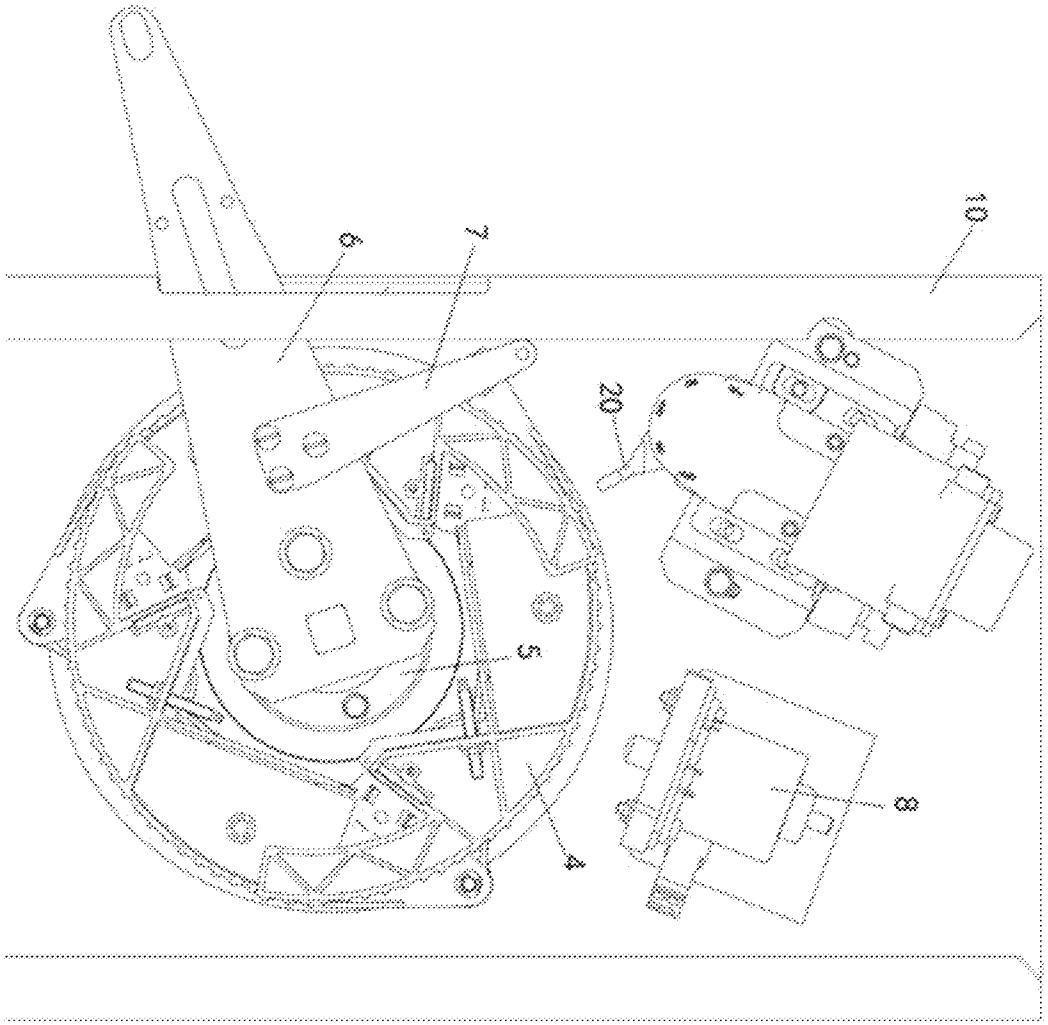
FIG. 4 illustrates a front view of a speed governor assembly according to an embodiment.

Referring to FIGS. 2, 3 and 4, perspective and front views, viewed at different angles, of the speed governor assembly when the sheave is not overspeeded are shown. It should be understood that only portions of the speed governor assembly that are closely related to the present invention are shown in the drawings, and that some of the components are omitted for clarity. The speed governor assembly according to an embodiment of the present invention includes: a frame 10, for example mounted to an elevator car; a sheave 3 rotatably arranged on a shaft and having a rope groove 31 in which the rope can be wound; a centrifugal mechanism 4 mounted on the sheave and rotated together with the sheave; an overspeed protection switch 20 at a first distance from a radial outer side of the centrifugal mechanism; a core ring 5 coaxial with the sheave and disposed in a radial side of the centrifugal mechanism 4; and a triggering arm 7 rotating together with the core ring 5; wherein the centrifugal mechanism 4 engages with the core ring 5 and drives the core ring 5 and the triggering arm 7 to rotate when the sheave 3 reaches the second speed, and the rotation of the triggering arm 7 can contact and trigger the overspeed protection switch 20. The present invention provides a triggering arm 7 associated with the core ring 5, ensuring that the overspeed protection switch 20 will be triggered not later than the mechanical brake device when the sheave reaches the second speed. In some embodiments, when the sheave 3 reaches the first speed, the centrifuge mechanism 4 is deployed to a degree such that it can contact and trigger the overspeed protection switch 20, and the first speed is less than the second speed. The speed governor assembly is also configured with a remote triggering device 8 for actively triggering the speed governor assembly.

The second speed, which may also be referred to as a mechanical brake device triggering speed limit, is determined by the centrifugal mechanism 4 itself and is not adjustable. The first speed, which may also be referred to as an overspeed protection switch triggering speed limit, is the speed at which the centrifugal mechanism 4 is deployed to push the overspeed protection switch 2. Since the centrifugal mechanism 4 is gradually deployed as the speed of the sheave 3 is increased, the degree of deployment depends on the speed of the sheave 3. The higher the speed of the sheave 3 is, the farther the centrifugal mechanism 4 is deployed. Therefore, the first speed can be adjusted by setting the first distance from the overspeed protection switch 20 to the centrifugal mechanism 4. In other words, it is possible to adjust to what extent the centrifugal mechanism 4 is deployed to push the overspeed protection switch 20 by adjusting the first distance, thereby adjusting the first speed of the sheave 3 and the centrifugal mechanism 4 at this time. In some embodiments, the first distance may be set such that the ratio of the first speed to the second speed is above 0.8, such as 0.8-0.9, preferably above 0.85, such as in the range of 0.85 to 0.9. In some embodiments, the first distance may be set such that the ratio of the first speed to the second speed is above 0.9, such as in the range of 0.9-1.0 (excluding 1.0), more preferably, above 0.95, such as in the range of 0.95-1.0 (excluding 1.0).

Figure 5:
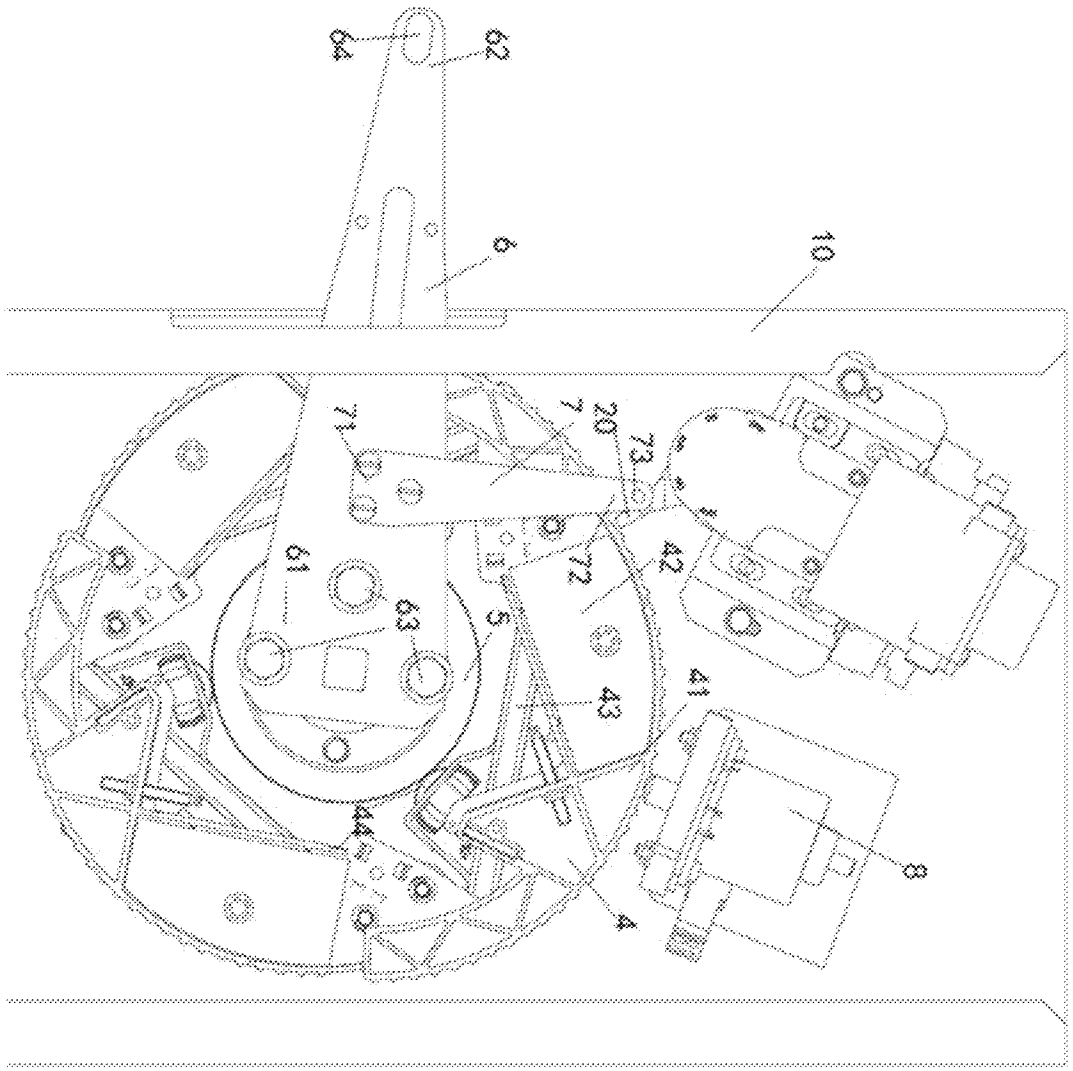
FIGS. 5 and 6 illustrate diagrams showing state changes of the speed governor assembly according to an embodiment when the sheave reaches a second speed.
Figure 6:
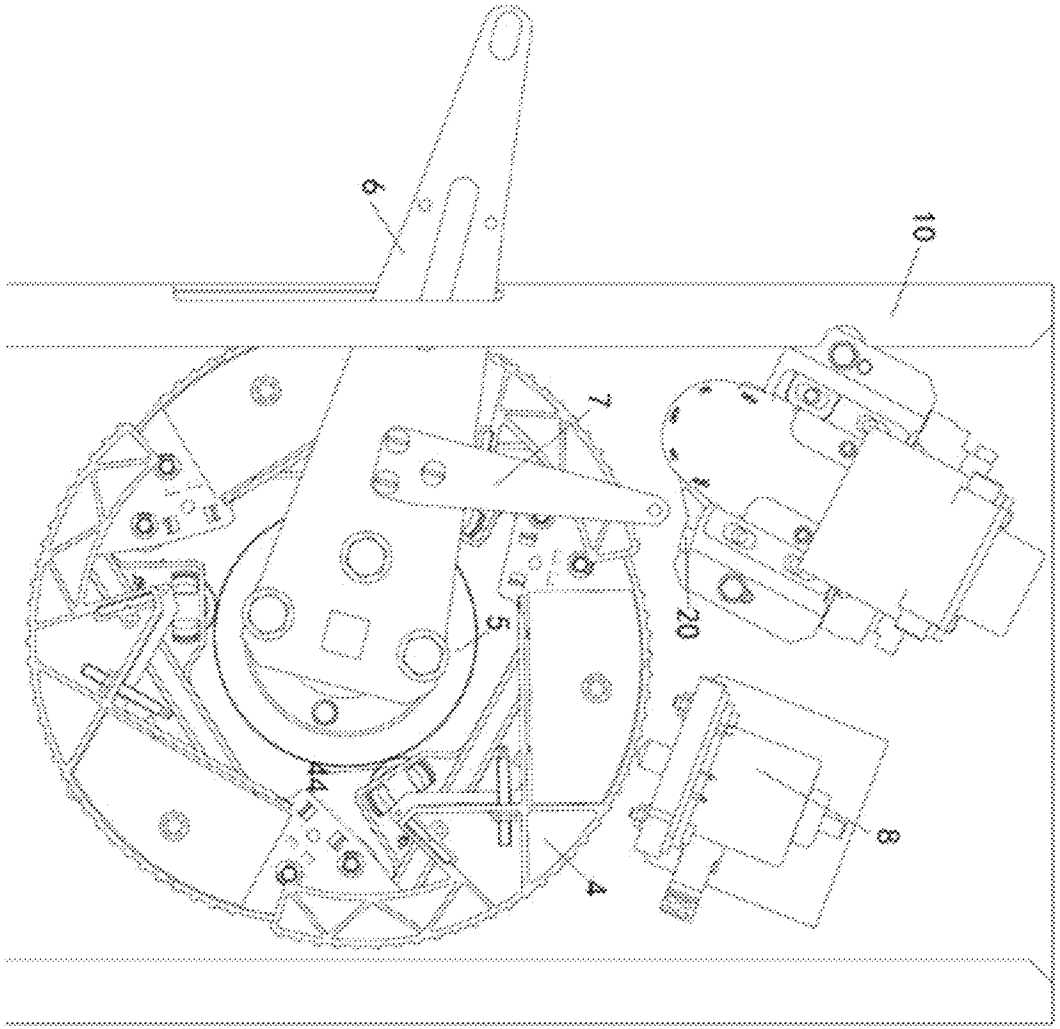

As can be seen from FIGS. 5 and 6, the centrifugal mechanism 4 is not fully rounded during deployment, and there are points in the peripheral contour of the centrifugal mechanism 4 that are farther or closer from the center of rotation. Although when the sheave reaches the first speed, the farther point on the centrifugal mechanism 4 can reach and trigger the overspeed protection switch 20, while those closer points, when being at the same angular position as the overspeed protection switch 20, may not reach the overspeed protection switch 20, thereby failing in triggering the overspeed protection switch 20. Increasing the first distance from the overspeed protection switch 20 to the centrifugal mechanism 4 will increase the risk that the overspeed protection switch 20 is not triggered or is triggered later than the mechanical brake device, which may cause damage to the elevator drive device and create a safety hazard. Since the presence of the triggering arm 7 ensures that the overspeed protection switch 20 is triggered not later than the mechanical brake device when the sheave reaches the second speed, the overspeed protection switch 20 can be set as far as possible. Therefore, the first speed can be increased as much as possible under the condition that the standard is met (for example, the standard of the first speed/the second speed being larger than 0.9), thereby increasing the difference between the first speed and the basic running speed, reducing the risk of the overspeed protection switch 20 being falsely triggered, and eliminating the possibility that the electrical action speed of the speed governor does not meet the requirements of the relevant national standards.

In some embodiments, the core ring 5 is also associated with a mechanical brake device, such that with the rotation of the core ring 5, the mechanical brake device is caused to rub against the elevator rail, thereby braking the car. In some embodiments, when the sheave reaches the second speed, the core ring 5 causes a rocker arm 6 to rotate and trigger the mechanical brake device. As shown in FIG. 2, the triggering arm 7 is connected to the middle portion between a first end 61 and a second end 62 of the rocker arm 6, at the inner side of the frame 10, and extends substantially upward. In some embodiments, the triggering arm 7 can be shaped as a plate as shown, or alternatively in a cylindrical shape or other suitable shapes. The triggering arm 7 has a proximal end 71 for connection with the rocker arm 6 or the core ring 5 and a distal end 72 for contacting and triggering the overspeed protection switch. The proximal end 71 of the triggering arm can be connected to the rocker arm 6 or the core ring 5 by, for example, a bolt. In some embodiments, the distal end 72 of the triggering arm 7 has an axial extension portion 73 that is aligned with the contact or active end of the overspeed protection switch 20. In this case, portions of the triggering arm 7 other than the axial extension portion 73 can be in a different plane with the overspeed protection switch 20. In an alternative embodiment, an axial extension portion may also be provided on the overspeed protection switch 20. In some embodiments, the triggering arm 7 and the overspeed protection switch 20 are on the same side of the rotation axis of the sheave 3, on the left side of the axis as in the embodiment shown in the figure, and the overspeed protection switch 20 is above the triggering arm 7.

Referring to FIGS. 5 and 6, there are shown diagrams of state changes of the speed governor assembly when the sheave reaches the second speed, according to an embodiment. In some embodiments, when the core ring 5 is rotated at a first angle (FIG. 5), the triggering arm 7 can contact and trigger the overspeed protection switch 20, and when the core ring 5 is rotated at a second angle (FIG. 6), the rocker arm 6 is fully pulled up, at which point the mechanical brake acts and the second angle is greater than or at least equal to the first angle. In the embodiment shown, the triggering arm 7 is connected to the rocker arm 6 and the rocker arm 6 is connected to the core ring 5. In an alternative embodiment, the triggering arm 7 can be directly connected to the core ring 5 or indirectly connected to the core ring 5 as long as it can rotate with the core ring 5 and trigger the overspeed protection switch 20. In some embodiments, the rocker arm 6 has a first end 61 and a second end 62. The first end 61 of the rocker arm 6 is connected to the core ring 5, for example through three bolts 63. The second end 62 of the rocker arm 6 has a connection port 64 for connection with a safety gear pull rod (not shown). As the rocker arm 6 rotates with the core ring 5, the second end 62 of the rocker arm 6 is raised and is caused to pull the safety gear via the safety gear pull rod. The safety gear then clamps the rail to stop the car. In some embodiments, the second end 62 of the rocker arm 6 passes through the opening 11 on the side of the frame. In some embodiments, the rocker arm 6 is shaped as a plate and substantially triangular.

Referring to FIG. 5, the centrifugal mechanism 4 includes a plurality of centrifugal block supports 41 each carrying a centrifugal block 42, (three centrifugal block supports 41 shown in the illustrated embodiment), and a plurality of connecting rods 43 connected between the plurality of centrifugal block supports 41, with a retaining mechanism, such as a spring device or a magnetic device, holding the plurality of centrifugal block supports 41 together. As the speed of the sheave 3 is gradually increased, the centrifugal block supports 41 are gradually deployed due to the received centrifugal force against the retaining force applied by the retaining mechanism. When the sheave 3 reaches the first speed, the centrifugal block supports 41 are deployed to the extent that enables triggering the overspeed protection switch 20. In some embodiments, a roller 44 inside the plurality of connecting rods 43 of the centrifugal mechanism 4 engages the core ring 5 and drives the core ring 5 and the rocker arm 6 to rotate, triggering the mechanical brake device. The specific structure of the centrifugal mechanism 4 can be of the type described in U.S. Patent Publication No. US20130098711A1 to Otis Elevator Company.

In another aspect, an elevator system configured with the speed governor assembly described according to various embodiments is also provided. The speed governor assembly may be mounted to the elevator car and the elevator system may be a low speed elevator, such as where the basic running speed of the car is less than 1.0 m/s.

The specific embodiments described above are merely illustrative of the principles of the present invention, in which various components are clearly illustrated or described to make the principles of the present invention more readily understood. Various modifications or changes may be easily made to the present invention by those skilled in the art without departing from the scope of the present invention. It is to be understood that these modifications or variations are intended to be included within the scope of the present invention.

What is claimed is:

1. A speed governor assembly, comprising:

a sheave;

a centrifugal mechanism mounted on the sheave and rotating together with the sheave;

an overspeed protection switch at a first distance from a radial outer side of the centrifugal mechanism;

a core ring disposed coaxially with the sheave; and a triggering arm rotating together with the core ring, the triggering arm configured to contact and trigger the overspeed protection switch when the sheave reaches a first speed;

wherein the centrifugal mechanism engages with the core ring and drives the core ring and the triggering arm to rotate when the sheave reaches a second speed;

wherein the centrifugation mechanism comprises a plurality of centrifugal block supports each carrying a centrifugal block, a plurality of connecting rods connected between the plurality of centrifugal block supports and a retaining mechanism holding the plurality of centrifugal block supports together;

wherein when the sheave reaches the second speed, a roller inside the plurality of connecting rods of the centrifugal mechanism engages with the core ring and drives the core ring to rotate.

2. The speed governor assembly of claim 1, wherein when the sheave reaches the first speed, the centrifugal mechanism is deployed to a degree such that the triggering arm contacts and triggers the overspeed protection switch.

3. The speed governor assembly of claim 2, wherein the first distance is set such that a ratio of the first speed to the second speed is in a range of 0.9-1.0.

4. The speed governor assembly of claim 1, wherein the triggering arm is directly connected to the core ring.

5. The speed governor assembly of claim 1, wherein the core ring drives a rocker arm to rotate and trigger a mechanical brake device when the sheave reaches the second speed.

6. The speed governor assembly of claim 5, wherein the rocker arm has a first end and a second end, the first end of the rocker arm is connected to the core ring, and the second end of the rocker arm is connected to a safety gear pull rod.

7. The speed governor assembly of claim 6, wherein the triggering arm is connected between the first end and the second end of the rocker arm and extends upwardly.

8. The speed governor assembly of claim 5, wherein the triggering arm is in a shape of plate or column, and the triggering arm has a proximal end for connection with the rocker arm or the core ring and a distal end for triggering the overspeed protection switch.

9. The speed governor assembly of claim 8, wherein the distal end of the triggering arm has an axial extension portion that is aligned with a contact end of the overspeed protection switch.

10. The speed governor assembly of claim 8, wherein the proximal end of the triggering arm is connected to the rocker arm or the core ring through a plurality of bolts.

11. The speed governor assembly of claim 1, wherein the triggering arm and the overspeed protection switch are on the same side of the rotation axis of the sheave.

12. The speed governor assembly of claim 11, wherein the overspeed protection switch is above the triggering arm.

13. The speed governor assembly of claim 1, wherein when the sheave reaches the first speed, the plurality of centrifugal block supports are deployed to a degree such that the overspeed protection switch can be triggered.

14. The speed governor assembly of claim 1, wherein the retaining mechanism is a spring device or a magnetic device.

15. An elevator system, wherein the elevator system is configured with the speed governor assembly according to claim 1.

16. The elevator system according to claim 15, wherein a basic running speed of an elevator car in the elevator system is less than or equal to 1.0 m/s.

17. An elevator system comprising:

an elevator car;

a speed governor assembly including:

a sheave;

a centrifugal mechanism mounted on the sheave and rotating together with the sheave;

an overspeed protection switch at a first distance from a radial outer side of the centrifugal mechanism;

a core ring disposed coaxially with the sheave; and a triggering arm rotating together with the core ring;

wherein the centrifugal mechanism engages with the core ring and drives the core ring and the triggering arm to rotate when the sheave reaches a second speed, and the rotation of the triggering arm can contact and trigger the overspeed protection switch wherein the speed governor assembly is mounted to the elevator car.

* * * * *